United States Patent [19]

Rucker

[11] Patent Number: 4,517,895

[45] Date of Patent: May 21, 1985

[54] ELECTRIC INITIATOR RESISTANT TO ACTUATION BY RADIO FREQUENCY AND ELECTROSTATIC ENERGIES

[75] Inventor: Klaus G. Rucker, Kinnelon, N.J.

[73] Assignee: E. I. Du Pont de Nemours and Company, Wilmington, Del.

[21] Appl. No.: 441,755

[22] Filed: Nov. 15, 1982

[51] Int. Cl.[3] ..... F42B 3/18

[52] U.S. Cl. ..... 102/202.2

[58] Field of Search ..... 102/202.2, 202.3, 202.1, 102/202.5, 202.14; 361/248

[56] References Cited

U.S. PATENT DOCUMENTS 3,264,989 3/1964 Rucker ..... 102/28

3,572,247 3/1971 Warshall ..... 102/202.2

*Primary Examiner*—Charles T. Jordan

[57] ABSTRACT

An RF-filter for an electric blasting cap comprises, in sequence from the cap's bridgewire, a first series-wired inductance plug (e.g., one or more ferrite beads), a shunt-wired resistance slug (e.g., conductive silicone rubber), two series-wired resistors (e.g., 27 ohm) in parallel geometry, and a second series-wired inductance plug adjacent the sealing plug on the cap. The filter elements are sheathed in a heat-resistant insulating and supporting sleeve, and an electrostatic flashover point is provided between the sealing plug and the inductance plug. The filter affords RF protection of 25 db between 1 and 4000 MHz, and withstands high current or voltage surges over a wide temperature range without permanent impairment.

11 Claims, 2 Drawing Figures

ELECTRIC INITIATOR RESISTANT TO ACTUATION BY RADIO FREQUENCY AND ELECTROSTATIC ENERGIES

BACKGROUND OF THE INVENTION

1. Field of the Invention

The present invention relates to an electric initiator, and more particularly to a filter for use in an electric initiator to protect it against accidental firing by radio frequency (RF) energy.

2. Description of the Prior Art

Protection against accidental exposure to radio frequency energy is desirable for most military electroexplosive devices and is sometimes needed for commercial blasting caps. Electrostatic and lightning discharges are as much a hazard to electroexplosive devices as electromagnetic radiation, and all should be obviated. The problem is to render this protection at a cost which will not substantially increase the base cost of a conventional electric blasting cap. This limitation excludes extraneous filters, which afford good protection, but are expensive. For example, the classical low-pass filters protect effectively against radio frequencies if built heavily enough to absorb inevitable losses in coils and capacitors. However they are expensive and are of negligible value against leg-to-leg electrostatic discharges because the basic D.C. component passes through with little loss. Other protection devices known in the art are expensive. Some of these do not provide protection against all extraneous electricity and are therefore impractical.

U.S. Pat. No. 3,264,989 describes an electric blasting cap having a low-pass RF-filter component consisting of an inductance plug (series inductance) and an adjacent resistance slug (shunt resistor), the latter being positioned adjacent the cap's sealing plug, and the former being separated from the cap's ignition charge by a heat insulation element. A typical series inductance is a ferrite bead of the composition $M(Fe_2)O_4$ wherein M is divalent Mn, Fe, Co, Ni, Cu, Mg, or Zn. The attenuation of such a low-pass filter is frequency-dependent and rather limited at frequencies in the one megahertz range that is used by powerful AM broadcast stations. While the filter of U.S. Pat. No. 3,264,989 gives excellent protection at higher communications frequencies, as might be encountered in military ordnance applications, it is inadequate for blasting situations where long connecting wires are readily intercepting energy in the one megahertz band. This situation prevails on oil well platforms where the high derrick and long borehole cables form effective broadcast-frequency antennas. Moreover, with the blasting cap of the aforementioned patent, it is possible that the shunt resistor, directly adjacent the sealing plug, will draw a heavy current, with resultant heating. This heating is limited only by the power limits of the radio frequency source, and the temperature of the filter and the blasting cap can rise sharply in a strong RF field. A powerful RF source might possibly swamp the shunt resistor, i.e., despite the current flow therethrough, the voltage across the cap still might be maintained at a level sufficiently high to allow current to flow through the bridgewire and fire the cap.

SUMMARY OF THE INVENTION

The present invention provides an improvement in the RF-protected electric initiator of U.S. Pat. No. 3,264,989, i.e., in an electric initiator having a metal shell integrally closed at one end and closed at its opposite end by a sealing plug, and containing an ignition composition and an electrical ignition assembly including, in sequence from the ignition composition, an inductance plug of a magnetic inductance composition and a resistance slug adjacent thereto, said inductance plug being slidably threaded, and said resistance slug being adherently threaded, on a first pair of separate electrical conductors, said pair of conductors being parallel to the longitudinal axis of the metal shell, in electrical contact with the resistance slug, and joined at a first one of their ends by a bridgewire contacting the ignition composition. The improvement of the invention comprises (a) an entrance inductance plug of a magnetic inductance composition adjacent the sealing plug; and (b) a pair of separate resistors between, and adjacent, the entrance inductance plug and the resistance slug, each of said resistors having (1), seated in the end thereof adjacent the resistance slug, the second end of one of said first pair of electrical conductors and (2), seated in the end thereof adjacent the entrance inductance plug, a first end of one of a second pair of separate electrical conductors, said second pair of conductors being parallel to the longitudinal axis of the metal shell, having the entrance inductance plug slidably threaded thereon, and each having a second end joined to a leg wire.

Thus, the initiator of the invention includes an RF-filter having, in sequence from the bridgewire to the sealing plug, a series-wired inductance plug, a shunt-wired resistance slug, two series-wired resistors in parallel geometry, and a series-wired inductance plug. The inductance plugs are slidable on the leads of the two resistors, and the shunt resistance slug adheres tightly to the two leadwires which extend to the bridgewire. The filter is sheathed in a heat-resistant insulating sleeve so that RF energy is forced to pass through all of the filter elements for maximum attenuation. An electrostatic flash-over point from the entrance inductance plug to the shell is provided by a space between the sealing plug and (a) the entrance inductance plug and (b) the end of the insulating sleeve. Any inductance plug in the filter can be a unitary body, such as a single bead, or a multi-sectioned body, such as multiple beads in tandem.

BRIEF DESCRIPTION OF THE DRAWING

In the accompanying drawing, which is presented for illustrative purposes only and is not to be construed as limiting the invention in any manner.

DETAILED DESCRIPTION

Figure 1:
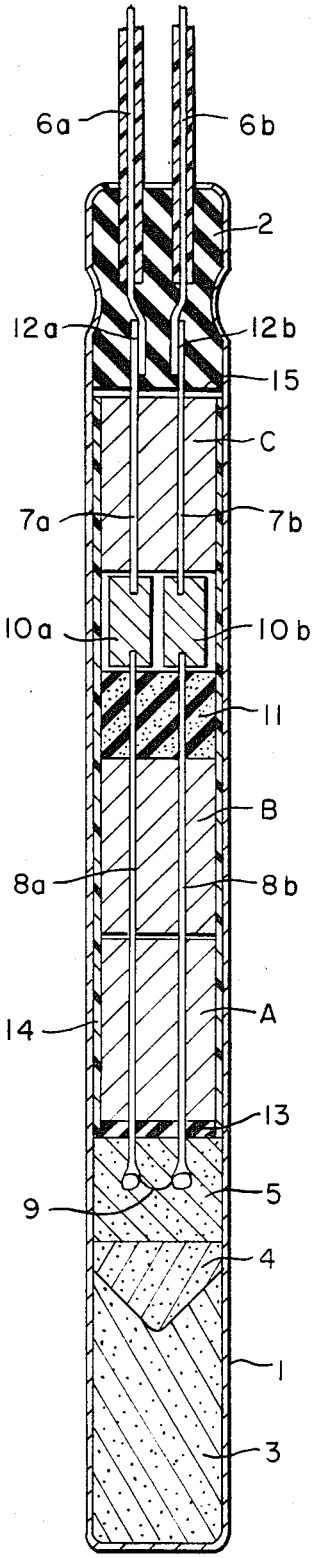
FIG. 1 is a cross-sectional elevation view of one embodiment of the RF filter of the invention.

In FIG. 1 the RF-filter is shown in position in an electrical blasting cap having a metal shell 1, e.g., made of aluminum, which is integrally closed at one end and closed at its opposite end by a sealing plug 2, made of a suitable solid material, e.g., rubber. In sequence from the closed end, shell 1 contains a base charge 3, a priming charge 4, and a heat-sensitive ignition charge 5.

Extending into plug 2 is a pair of insulated electrical conductors 6a,6b, known as leg wires, which can be of copper, iron, or aluminum and preferably are wires having high skin-effect loss.

The bared ends of conductors 6a,6b are soldered or spot-welded at 12a,12b to a pair of conductors 7a and 7b, respectively, which form part of the RF filter that also contains a pair of conductors 8a,8b joined to an electrically resistant bridgewire 9 in contact with ignition charge 5.

In the RF filter, 10a and 10b are a pair of series-wired resistors arranged in parallel geometry, resistor 10a having leadwire 7a seated in one end, and leadwire 8a in the opposite end, thereof; and resistor 10b having leadwire 7b seated in one end, and leadwire 8b in the opposite end, thereof. Resistance slug 11, e.g., a conductive silicone rubber plug, fits snugly around bare leadwires 8a,8b so as to make good contact therewith. Two components of an inductance plug, A and B, e.g., ferrite beads, are slidably threaded onto wires 8a,8b, and a high-temperature-insulating layer 13, e.g., of silicone rubber, fits snugly over wires 8a,8b. Bridgewire 9 is soldered to the ends of wires 8a,8b. When the filter is placed in position in the cap shell, bridgewire 9 becomes embedded in ignition charge 5, and layer 13 keeps powder from migrating into the filter.

Entrance inductance plug C, e.g., a ferrite bead, slides over leadwires 7a,7b, and the entire threaded filter assembly is sheathed in heat-resistant insulating liner 14, which extends from insulating layer 13 to the outer end of inductance plug C. A gap between sealing plug 2 and (a) inductance plug C and (b) the end of liner 14 forms an electrostatic flash-over location 15. Plug 2 forms an air- and water-tight closure between legwires 6a,6b and the outer metal shell 1 of the blasting cap.

In an alternative embodiment, one section of the inductance plug A,B, i.e., section B, is in the entrance inductance plug portion of the filter, forming a plug B,C and leaving only section A between resistance slug 11 and bridgewire 9.

Figure 2:
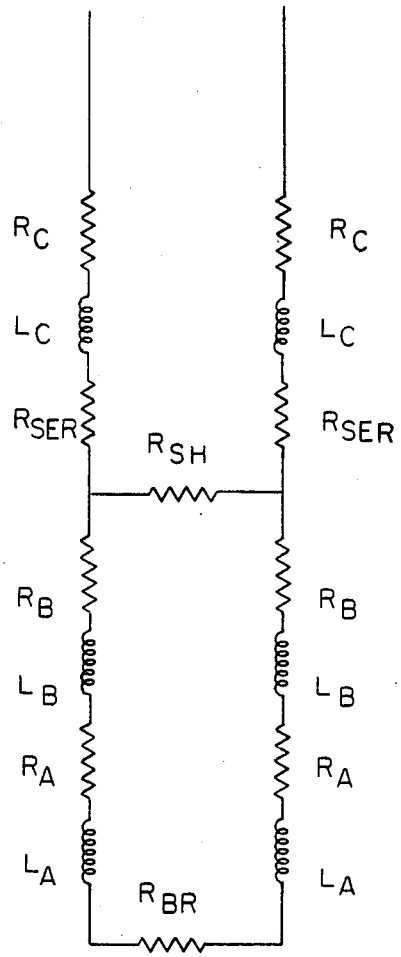
FIG. 2 is the electrical circuit diagram for the filter shown in FIG. 1 when joined to the bridgewire in the electrical blasting cap of the invention, the wiring for each filter component being geometrically aligned with its respective component in FIG. 1.

Referring to FIG. 1, in normal direct-current or capacitor discharge firing, the firing current enters at 12a,12b and goes through incoming leadwires 7a,7b of resistors 10a,10b, then through resistors 10a,10b, and out through the resistor leadwires 8a,8b to bridgewire 9. Regular firing current is therefore only attenuated by passage through the resistors 10a,10b. Said resistors each have a value between 5 and 50 ohms. Regular firing energy is not influenced at all by the presence of the inductance plugs A,B, and C. The inductance plugs are electrically nonexistent at direct-current or low frequencies. At high frequencies, where attenuation of incoming energy is desired, all circuit elements are active and subject the hazardous high-frequency signal to severe attenuation. The inductance plug components A,B, and C are most commonly ferrites, described in further detail below, but could be any other electromagnetically active compound or coils of wire. At high frequencies beyond 100 kilohertz the inductance plug assumes (FIG. 2) a series loss resistance $R_A$, $R_b$ (or $R_C$) and series inductance $L_A$, $L_B$ (or $L_C$).

The inductance plugs act as if the leadwires (solid copper) of resistors 10a,10b had somehow been cut and $L_A-L_B$, $R_B-L_C$, $R_C$ had been inserted and had reestablished the circuit. The effective insertion of the series loss resistances $R_{A,B,C}$ and the series loss inductances $L_{A,B,C}$ is accomplished under the electromagnetic laws of nature. The resistance slug 11 contacts both bare copper wires as they emerge from resistors 10a,10b and places a shunt resistance $R_{SH}$ across the line.

In the preferred embodiment of the invention, resistance slug 11 is formed from conductive silicone rubber and is pushed over both copper wires with a tight fit. This resistance slug 11 places between 5 and 200 ohms across the line to the bridgewire. This resistance $R_{SH}$ is large compared to the bridgewire resistance and only a few percent of the firing energy is taken away at dc or power line frequencies. However, at radio frequencies, inductance plug A,B of the FIG. 1 filter assumes a high impedance, formed of $L_A$ and $R_A$, and $L_B$ and $R_B$. Instead of going through the now high-impedance pathway $-R_B$, $L_B-R_A$, $L_A-R_{BR}-R_A$, $L_A-R_B$, $L_B-$ the current goes preferentially through $R_{SH}$ and in so doing drastically lowers the bridgewire current. The inductance plug A,B by having assumed a high impedance at radio frequencies, will require that a much higher voltage be impressed on the resistance 11 to maintain a particular current flow through the bridgewire than would be required at dc. The two parallel resistors 10a,10b maintain their resistance value, for example 27 ohms each, at all frequencies. The entrance inductance plug C increases its series insertion impedance, as explained above: $L_C$, $R_C$ is inserted into the line as the frequency increases into the megahertz range. Part of the incoming RF energy is therefore attenuated and a high impedance is placed in series with the resistors 10a,10b. The current that flows into resistors 10a,10b must overcome the high series-inserted impedance plug C. A much higher voltage must therefore be impressed on the input of the filter at solder joints 12a,12b.

In the embodiment of the invention shown in FIG. 1, the inductance plug A,B, of total length of about from 12 to 38 mm, forms a current divider network with the shunt resistance slug 11. To the extent that $L_A$, $R_A$ and $L_B$, $R_B$ in FIG. 2 increase with increasing frequency, current through the bridgewire gradually decreases and instead bypasses the bridge branch and shunts away through $R_{SH}$ of the resistance slug 11. In the 10 MHz frequency range, the impedance of plug A,B is in the 500 ohm range and less than 10% of the current entering at 12a,12b passes through the bridgewire, the remaining 90% passing through the shunt resistance $R_{SH}$ of resistance slug 11.

In the filter shown in FIG. 1, the inductance plugs, if made of ferrite beads, should have a total minimum length of about 25 millimeters to insure adequate attenuation. A long ferrite section A,B insures high current bypassing through the shunt resistance 11. A long ferrite section C insures high series impedance insertion. If the inductance plugs A, B, and C are formed by wire wound coils, they should have an inductance of at least about 10 microhenry each.

The two series-wired fixed resistors 10a,10b on whose leadwires the inductance plugs A, B, and C and the shunt resistance slug 11 are skewered, add series resistance independent of frequency. The voltage that must be provided from the stray RF source before it can drive an undesirable current of more than 50 milliamperes through the bridgewire is greatly increased because the shunt current through $R_{SH}$ creates a large voltage drop across the two series-wired and parallel-mounted resistors 10a,10b. Their value should be between 5 and 50 ohms each.

The series-wired fixed resistors 10a,10b are always active in the circuit, from dc to the microwave band.

They protect against galvanic and stray power-line currents. Such currents are occasionally superposed on an electroexplosive device along with radio-frequency currents.

The inductance plugs may be any magnetic material exhibiting high permeability and may be in the form of a solid plug or a multiturn coil. Preferably they will have an inductance of at least about ten microhenry. Good examples of such a material are the ferrites, which usually are spinels containing an oxide of iron in combination with some other metal oxide or combination of oxides, for example $M(Fe_2)O_4$ wherein M is divalent Mn, Fe, Co, Ni, Cu, Mg, or Zn. The inductance plug must surround the conductors. The inductance plug may be designed so that the conductors can be passed through two holes parallel to the cylinder axis, or the plug can have a split construction so that the wires can be wrapped around the stem of one part and that the other part can close the magnetic flux. Such two-part ferrite cores are known as pot-cores in the art.

As an example illustrative of the invention, the filter shown in FIG. 1 was made by using 12.7-mm-long, 6.35-mm-diameter two-hole ferrite beads as inductance plugs A,B, and C. The diameter of the holes in the beads was 1.14 mm. The beads had a Curie point of 160° C. and an initial permeability of 5000. Volume resistivity should be high enough so that regular firing energy is not excessively shunted through bead C (FIG. 1). Thin Teflon ® tubing or silicone rubber potting compound is used to insulate the leadwires of resistors *10a,10b* as they pass through ferrite bead C if that is necessary in the case of low-volume-resistivity ferrites.

Extended high frequency protection into the microwave range is provided in the filter shown in FIG. 1 if the entrance ferrite bead C is a 350° C. Curie-temperature ferrite of $10^7$ ohm-cm and initial permeability of 125. Such cobalt-nickel-zinc ferrites retain some inductance and increase resistance well into the gigahertz range. The remaining two ferrites A and B in FIG. 1 can be of the type described above with permeability 5000.

The resistance slug 11 may be any material having an in situ resistance between 5 and 200 ohms, preferably on the low side of this range. A radio carbon-resistance material in an organic binder or a ceramic-resistance material or carbon-black loaded silicone rubber are such suitable resistance slug materials. It is necessary that uniform electrical contact be made between the resistance slug and the wires. This can be accomplished by (1) molding metallic tubes in the resistance slug to tightly engage the wires, (2) cementing the conductors in the resistance slug with a conductive element, (3) molding the resistance slug directly onto the electrical conductor wires, or (4) welding or soldering the resistance slug containing molded-in wire, to the electrical conductors by means of the molded-in wires or (5) forming a 6 mm diameter continuous extrusion of conductive silicone rubber with two small holes of 0.4–0.5 mm diameter, which is then cut to 6-mm-long plugs. The small holes allow easy starting of the resistor leadwires through the plug, yet, being smaller than the wire diameter, grip the leadwires tightly.

Silicone rubber resistance slugs withstand heavy current surges. They also have excellent heat stability, which is important for high-temperature oil well electric blasting caps. Furthermore, their dc resistance decreases with increasing frequency because the ohmic carbon-carbon particle resistance is increasingly bypassed by the capacitance between carbon particles. The shunt impedance is thus lower and gives better protection as the frequency increases.

The two series-wired resistors used in the filter of this invention are most conveniently selected from the wide assortment of commercial radio resistors. Quarter-watt carbon-composition resistors will fit side-by-side into a 6-mm ID blasting cap shell. The resistance values of each are between 10 and 50 ohms. The exact value depends on the bridgewire minimum firing current. The customary minimum firing current of 0.7 ampere overloads the quarter-watt resistors and they will burn out in a fraction of a second. This is long enough for the twenty or so milliseconds of bridgewire initiation. A radio resistor having a resistance value greater than 50 ohms would need a higher wattage rating or high-temperature and overload-proof construction if used with the same bridgewire. The 38-mm long leadwires of the radio carbon resistor, with 27 ohms preferred value, serve as support for the ferrite beads and the silicone rubber plug.

The insulating, high-temperature-withstanding sleeve 14, made, for example, of a polyimide, such as Kapton ®, or of Teflon ® polytetrafluoroethylene resin, encloses the filter tightly so that it supports the filter elements and prevents arcing to the shell from any element of the filter. Only location 15 allows ready flashover from the leadwires of the series resistor to the shell. This provides a safe location for the discharge of electrostatic charges. A polyimide sleeve may be a spiral-wrapped tube, and a Teflon ® sleeve an extruded or spiral-wrapped tube, or one made from longitudinally overwrapped tape.

The insulating polymeric or elastomeric sealing plug 2 provides for the closure of the metal shell. Two phenomena are taking place concurrently as high-frequency energy is applied to the filter: First, all inductance plugs take on a high inductive series impedance with a high resistive component, and, second, RF energy is increasingly shunted through the conductive silicone rubber slug 11 because the inductance plug next to the bridgewire limits the bridgewire current. The effects of both are protection for the bridgewire, which now sees much less current at radio frequency than at dc for any constant voltage impressed at the input.

The filter of this invention has given an energy attenuation of 25 decibels or more over the frequency range from 1 MHz to 4000 MHz. The decibel value is determined as:

$$DB = 10 \log_{10} (P_2/P_1)$$

where $P_1$ is the power dissipated in the bridgewire alone and $P_2$ is the power dissipated in the transfer resistance. The transfer resistance is defined as:

$$R_T = \frac{\text{Voltage in Cap}}{\text{Bridgewire Current}}$$

This relation is $R_T = 55$ ohms at direct current firing where $(2 \times 27) + 1 = 55$ represents both resistors and the bridge resistance.

At radio frequencies it appears as if a much higher transfer resistance $R_T$ was inserted in series with the bridgewire. A much higher RF voltage can now be tolerated at the filter input to give the same bridgewire current as a much lower dc voltage. This is the principle of radio frequency hazard protection: the cap turns into a much less sensitive circuit at high frequencies. For the circuit of FIG. 2, the following decibel values were measured with signal oscillators and a Boonton Electronics Radiofrequency millivoltmeter 92 BB.

The circuit used two $\mu=5000$ ferrites A and B in the bridgewire section and a $\mu=125$ ferrite C in the input section.

TABLE I

| Frequency MHz | Transfer Resistance | $\frac{R_T}{55}$ Ratio | Decibels $10 \log_{10} (P_2/P_1)$ db |
|---|---|---|---|
| 1 | 789 | 14.34 | 28.97 |
| 2 | 1154 | 20.98 | 30.62 |
| 3 | 1364 | 24.8 | 31.35 |
| 5 | 1500 | 27.27 | 31.76 |
| 100 | 2667 | 48.49 | 34.26 |
| 200 | 2273 | 41.33 | 33.56 |
| 500 | 2080 | 37.82 | 33.18 |

The above table shows how the 55 ohm dc resistance rises into the 2000 ohm and higher range as the frequency increases. The filter affords ample radio frequency protection for the bridgewire and its surrounding ignition charge. The numerical relation between decibel and power attenuation is shown here as:

| | | | | |
|---|---|---|---|---|
| Decibels: | 10 | 20 | 30 | 40 |
| Power Attenuation: | 10 | 100 | 1000 | 10000 |

Values of 10 to 25 decibels are customarily required for ordnance items, whereas communication gear requires 40–100 decibels of attenuation.

I claim:

1. In an electric initiator having a metal shell integrally closed at one end and closed at its opposite end by a sealing plug, and containing an ignition composition and an electrical ignition assembly including, in sequence from said ignition composition, an inductance plug of a magnetic inductance composition and a resistance slug adjacent thereto, said inductance plug being slidably threaded, and said resistance slug being adherently threaded, on a first pair of separate electrical conductors, said pair of conductors being parallel to the longitudinal axis of said metal shell, in electrical contact with said resistance slug, and joined at a first one of their ends by a bridgewire contacting said ignition composition, the improvement comprising (a) an entrance inductance plug of a magnetic inductance composition adjacent said sealing plug; and (b) a pair of separate resistors between, and adjacent, said entrance inductance plug and said resistance slug, each of said resistors having (1), seated in the end thereof adjacent said resistance slug, the second end of one of said first pair of electrical conductors and (2), seated in the end thereof adjacent said entrance inductance plug, a first end of one of a second pair of separate electrical conductors, said second pair of conductors being parallel to the longitudinal axis of said metal shell, having said entrance inductance plug slidably threaded thereon, and each having a second end joined to a leg wire.

2. An initiator of claim 1 wherein a heat-resistant insulating and supporting sleeve tightly encloses said inductance plugs, resistance slug, and pair of resistors, an electrostatic flashover location being provided between said sealing plug and said entrance inductance plug by causing said insulating sleeve to terminate short of said sealing plug.

3. An initiator of claim 1 wherein said ignition composition is separated from the inductance plug nearest thereto by an insulating layer.

4. An initiator of claim 2 wherein each of said pair of resistors has a value of about from 5 to 50 ohms; the resistance of said resistance slug is at least about five times the resistance of said bridgewire, and is in the range of about from 5 to 200 ohms; and said inductance plugs are ferrite beads totalling at least about 25 millimeters in length, said entrance inductance plug having a length in the range of about from 6 to 38 millimeters and said inductance plug adjacent said resistance slug having a length in the range of about from 12 to 38 millimeters.

5. An initiator of claim 1 wherein one or both of said inductance plugs consist of multiple sections.

6. An initiator of claim 4 wherein said resistance slug is made of a conductive silicone rubber.

7. A filter for attenuating radio frequency energy comprising a pair of series-wired resistors in parallel geometry, each of said resistors having an electrical conductor seated in each of its two opposite ends to form a first and second pair of oppositely disposed parallel electrical conductors, said first pair of conductors being adapted to support a bridgewire at their terminals and having threaded thereon, in sequence from said resistors, (a) a shunt-wired resistance slug tightly adherent to said conductors, (b) a series-wired first inductance plug slidable on said conductors, and (c) an insulating member in snug fit on said conductors; and said second pair of conductors being adapted to be joined at their terminals to a pair of legwires and having a series-wired second inductance plug slidably mounted thereon adjacent said resistors; said resistors, resistance slug, and inductance plugs being surrounded by a heat-resistant insulating sleeve extending continuously from said second inductance plug to said insulating member.

8. A filter of claim 7 wherein each of said pair of resistors has a value of about from 5 to 50 ohms; the resistance of said resistance slug is in the range of about from 5 to 200 ohms; and said inductance plugs are ferrite beads totalling at least about 25 millimeters in length, said second inductance plug having a length in the range of about from 6 to 38 millimeters and said first inductance plug in the range of about from 12 to 38 millimeters.

9. A filter of claim 7 wherein one or both of said ferrite beads consist of multiple sections.

10. A filter of claim 7 wherein said insulating sleeve is a spiral-wrapped polyimide tube.

11. A filter of claim 7 wherein said insulating sleeve is an extruded, spiral-wrapped, or longitudinally wrapped tube of polytetrafluoroethylene.

* * * * *